US005661918A

United States Patent [19]

Malcolm et al.

[11] Patent Number: 5,661,918

[45] Date of Patent: Sep. 2, 1997

[54] COMBINED EVENT CALENDAR AND PICTURE FRAME

[75] Inventors: John J. Malcolm, 1704 Carleton Ct., Redwood City, Calif. 94061-2666; Thomas Shalvarjian, San Francisco, Calif.

[73] Assignee: John J. Malcolm, Redwood City, Calif.

[21] Appl. No.: 672,449

[22] Filed: Jun. 28, 1996

[51] Int. Cl.[6] ..... G09F 3/00

[52] U.S. Cl. ..... 40/107; 40/110; 40/119; 40/120; 281/33; 283/2

[58] Field of Search ..... 40/107, 119, 110, 40/120; 281/33; 283/2, 3, 4

[56] References Cited

U.S. PATENT DOCUMENTS

| | | | |
|---|---|---|---|
| 553,963 | 2/1896 | Palmer | 281/33 |
| 3,513,579 | 5/1970 | Christensen | 40/102 |
| 4,947,564 | 8/1990 | Reece et al. | 40/110 |
| 5,426,876 | 6/1995 | Jagoe et al. | 40/119 |

*Primary Examiner*—Kenneth J. Dorner
*Assistant Examiner*—Cassandra Davis
*Attorney, Agent, or Firm*—Carol D. Titus; Leary, Titus & Aiello

[57] ABSTRACT

A combination desktop calendar and picture frame which allows a user to insert his or her picture or photo of choice into the front cover of the calendar. A plurality of calendar pages are held inside the front cover. The calendar pages are somewhat wider than the front cover so that a portion of the calendar page is visible to one side of the front cover. The visible portion has a compact calendar printed on it which can be highlighted by marking important dates or by placing self stick clear or transparent, tinted shapes over important dates, each shape corresponding to a different type of event such as birthdays, anniversaries or the like. The internal construction of the calendar is such that the calendar pages may be flipped so that the current month or week is at the front most location after opening the front cover. An easel or magnetic backing is included for holding the unit in a substantially upright position on a desktop or countertop or attached to a refrigerator, file cabinet, wall, etc. An alternate embodiment includes an annual, refillable calendar section.

28 Claims, 4 Drawing Sheets

COMBINED EVENT CALENDAR AND PICTURE FRAME

BACKGROUND OF THE INVENTION

1. Field of the Invention

This invention relates in general to calendars and more specifically to a desktop-size calendar with means for easily identifying events or special occasions in combination with an integrated picture frame.

2. Description of Prior Art

Calendars with spaces available for marking events exist. Additionally, calendars with pictures or photographs attached in some manner also exist. Usually calendars display a new picture with each month. In some cases calendars have been designed so that a person can put their own pictures or photographs in the space above the calendar page as in U.S. Pat. No. 5,426,876 issued on Jun. 27,1995 to B. and J. Jagoe.

The problem with most calendars that incorporate pictures or photographs is that they usually take up a large amount of space and become impractical to use on a desktop or countertop. Desktop calendars with pictures or photographs exist, but generally incorporating both together means that the picture or photograph and/or the calendar must be quite small, thereby making them difficult to see and read. A calendar with enough space to write down an event or special occasion such as "Tracy's Birthday" or "Jo's Anniversary" means that the calendar needs to be of sufficient size to accomplish this task which compounds the problem of size with respect to taking up space on a desktop or countertop. Finally, a calendar with hand writing on it can look messy and not conducive to a neat desk or counter environment.

The above problems will be solved with the application of the present invention which will be described below.

SUMMARY OF THE INVENTION

It is an object of this invention to provide a self-supporting desktop calendar with a picture frame integrated into the front of the cover.

Another object of the present invention is to provide a desktop calendar which has the days of the month compactly displayed to one side of the picture frame.

Another object of the present invention is to provide a combination desktop calendar and picture frame in which the days of the month can be easily highlighted with see-through color tinted shapes to indicate an event.

Another object of the present invention is to provide a combination picture frame and desktop calendar which is constructed in such a way that there is a page for each month of the year which can be flipped back thereby allowing the desired month's page to be the first page viewed after opening up the front of the cover.

A further object of the present invention is to provide a combination picture frame and desktop calendar whose back cover includes an integrated easel or other support which allows the device to stand in a substantially upright position.

A further object of the present invention is to provide a combination desktop calendar and picture frame which can be economically injection molded out of plastic or die cut, scored and manufactured from paperboard or other thin material.

Yet another object of the present invention is to display the dates of the current month in a compact manner to provide a way to indicate dates on which an event occurs.

In keeping with these objectives, the present invention takes the form of a desktop calendar which includes an integrated photograph/picture frame on the front of its cover, while the days of the particular month are displayed in compact form to one side of the frame. Important dates are highlighted on the compactly displayed calendar with transparent, color-tinted dots, circles or other shapes or may be marked with a pen or pencil. A further detailed description of an important event or events can be seen by opening up the picture frame and exposing one of the twelve monthly pages which has a writing space corresponding to each day of the month. Extra spaces have been provided for situations in which more than one event occurs on the same day. In this case an indicator is placed on the date beside the detailed description of the first event. This refers the user to a second writing space where there is a detailed description of the second event. A variation on this would have the user placing two shapes over the date on the compactly displayed calendar of the month.

A similar designed calendar using daily, weekly, quarterly, yearly, etc. pages is also possible. The design of the present invention is such that the current month can be made to be the front-most page of the calendar after opening up the front of the cover. Other objects and advantages of the invention will no doubt occur to those skilled in the art upon reading and understanding the following detailed description along with the accompanying drawings.

DETAILED DESCRIPTION OF THE PREFERRED EMBODIMENT

Figure 1:
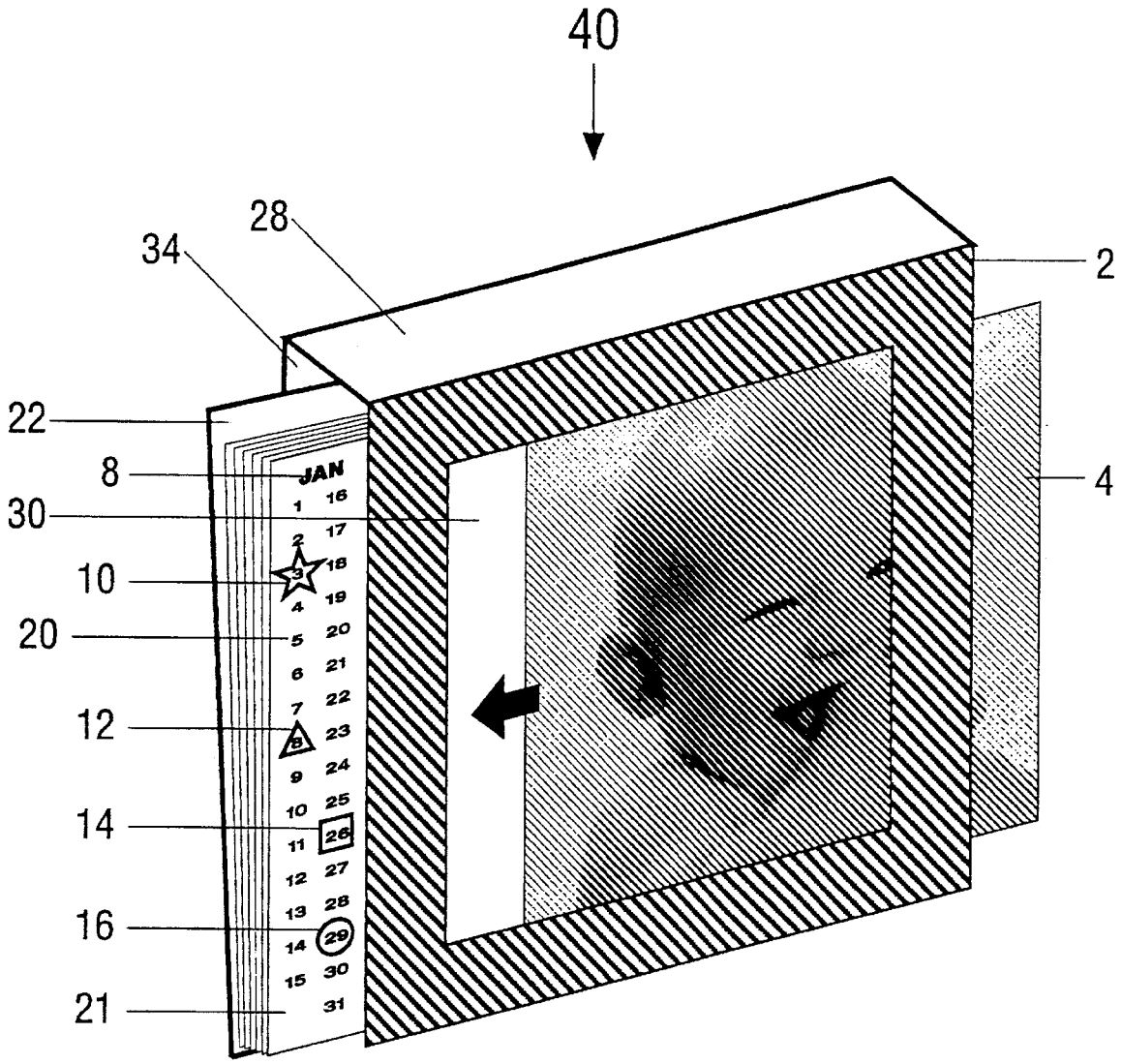
FIG. 1 is a front perspective view of the combination desktop calendar and picture frame of the present invention with a photograph partially inserted into the frame.

For clarity and ease of understanding, the same reference numbers are used to refer to similar structures throughout the drawing figures.

FIG. 1 shows the combination desktop calendar and picture frame 40 of the present invention. A photograph 4 is shown partially inserted into the picture frame 2, 30. Part of a monthly calendar page 21 protrudes out to expose a compact calendar 20 on a visible portion of the calendar page 21, in this case, for the month of January 8. Dates can be highlighted by marking shapes with a pen or pencil or by the application of transparent tinted shapes 10, 12, 14, 16, or opaque cut-outs which may be included when purchasing the calendar 40. The different shapes or colors can be indicators for different types of dates. Types of dates include events, occassions and any other system of dates. For example a star shape 10 can mean a birthday. A triangular shape 12 can mean an anniversary and so forth. A user could also choose to mark other types of dates such as work holidays, medical appointments, social obligations, work deadlines, etc. The above ideas are examples only, a user could also develop their own set of guidelines for using the calendar 40 that would suit their own needs.

Figure 2:
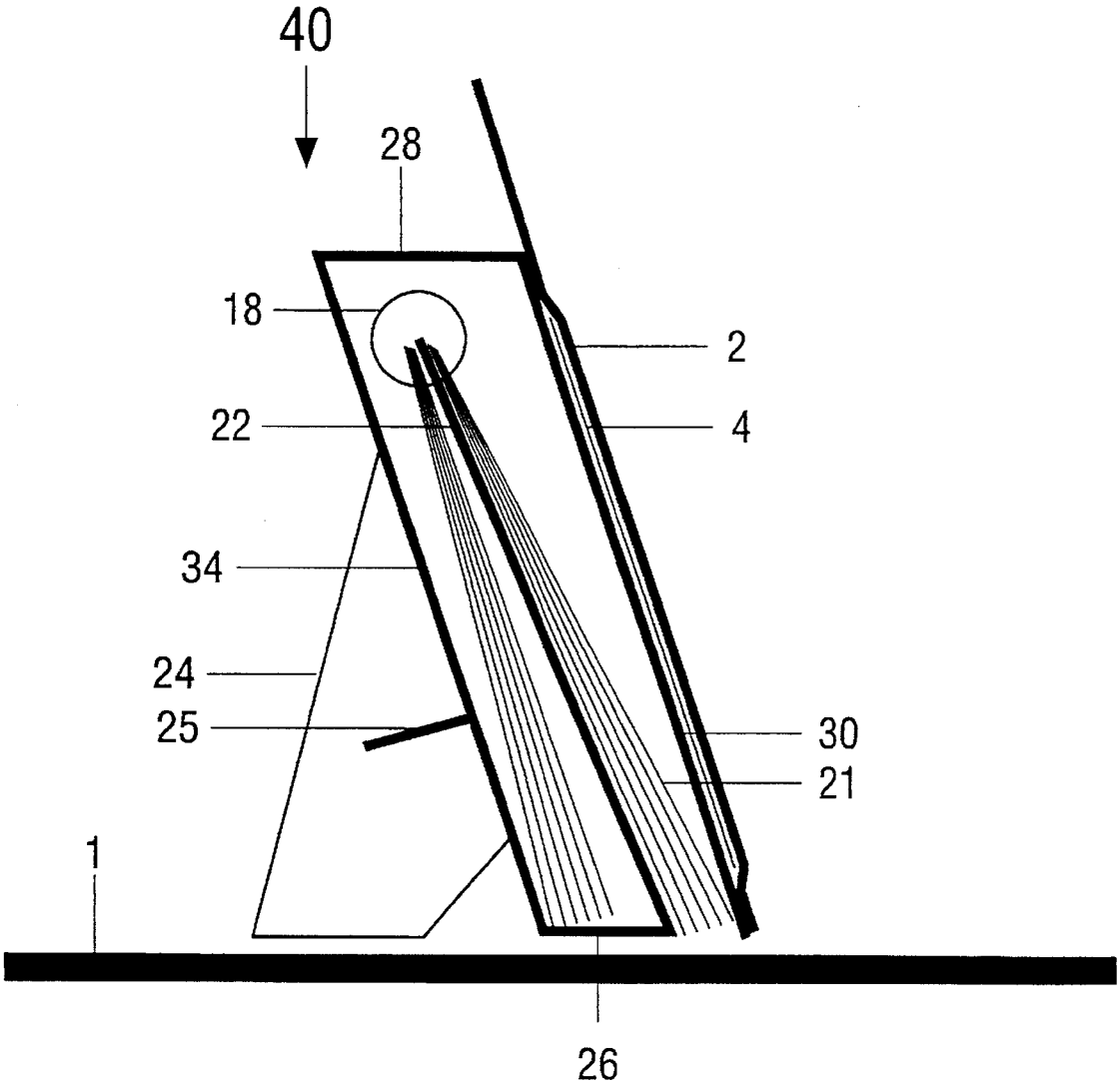
FIG. 2 is a side view of the combination desktop calendar and picture frame.

FIG. 2 shows a side view of the present invention 40 where the integral easel back 24 is folded out 90 degrees and the tab 25 holds the easel back 24 in place thereby allowing the calendar 40 of the present invention to stand in a substantially upright position. Optionally, the back panel 34 may be magnetic or have a magnetic material attached to it such that the calendar 40 may be magnetically attached to a refrigerator, file cabinet or other similar surface. Another variation would have a hole or a slot in the back panel 34 so that the calendar 40 could be hung on the wall.

In order to ease the insertion and removal of the picture 4, a portion of the mat 2 or frame back 30 may be debossed, compressed or otherwise formed. This would typically be the area where the mat 2 and frame back 30 were not glued together. This would leave a slight gap between the mat 2 and the frame back 30. An alternate method of obtaining a similar gap is to use one or more offset members. These offset members would be placed between the mat 2 and the frame back 30 and have the thickness of the desired gap. They could take many different forms, for example, there could be a strip along the top and a strip along the bottom. This configuration would allow the user to insert a picture 4 from either side. The offset member could also be a single U-shaped member that left only one side open. The embodiment shown in FIG. 2 has the mat 2 shaped such that the middle portion of the side is bowed out from the frame back 30. However, in the calendar's 40 simplest form, there would be no treatment to create this gap. It would be up to the user to slip the photograph 4 into whatever space was between the mat 2 and frame back 30 on the unglued side of the picture frame 2, 30.

Figure 3:
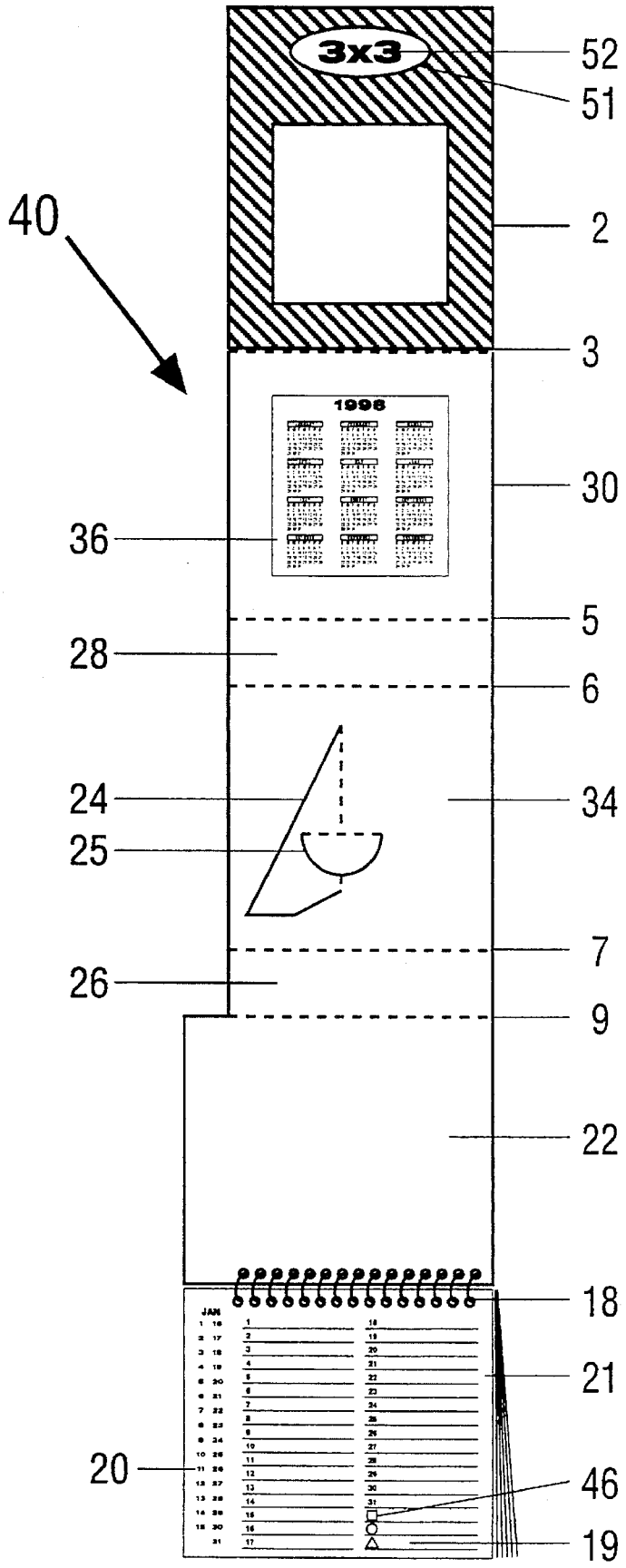
FIG. 3 is a plan view of the combination desktop calendar and picture frame.

In the embodiment of FIG. 3, the front section of the picture frame, the mat 2, is the first section of a continuous, scored paperboard strip. Dotted lines 3, 5, 6, 7, 9 are score lines where the paperboard is to be bent. The first line 3 is between the mat 2, forming the front section of the picture frame, and the frame back 30. In a preferred embodiment, a standard calendar 36 is placed, for example as a tear-off notepad of several years or a label or printing on the frame back 30, which is visible when the picture frame 2, 30 is opened up to view the hidden portion 19 of the calendar page 21. This would allow a user to determine the day of a week or easily view future or past months. The second line 5 marks the division between the frame back 30 and the top panel 28. The third line 6 marks the division between the top panel 28 and the back panel 34 which has the easel 24, 25, magnetic material, hole or slot. The fourth line 7 is between the back panel 34 and the bottom panel 26. The fifth line 9 marks the division between the bottom panel 26 and the internal panel 22. The example given shows and describes the unit 40 formed from paperboard which is folded to form the cover; however, the cover, or the frame alone, could also be formed from other materials such as plastic, which could be injection molded, electronic circuit boards, metal, glass, wood, foamboard, leather, cloth, synthetic material, vinyl, paper, ceramic, etc.

The embodiment shown in FIGS. 2 and 3 has an area 51 at the top of the frame mat 2 for an advertisement 52. If a significant area were needed, the mat 2 could be extended above top panel 28 to provide the necessary room. If an opening were made through the full thickness of the mat 2, an additional panel could be added to the top which would fold over and cover the back of the opening. This panel would also provide a place to put a logo or company information. Advertising 52 could also be added by debossing an area 51 of the mat 2 and placing a printed label in this area 51, or silk-screening a logo or company information onto the mat material 2. If preferred, this advertising section could also be placed in other locations, such as on the mat 2 around the sides of the picture 4 opening. These embodiments, having the advertising option, would be especially useful for company gifts, company advertising, etc.

Figure 4:
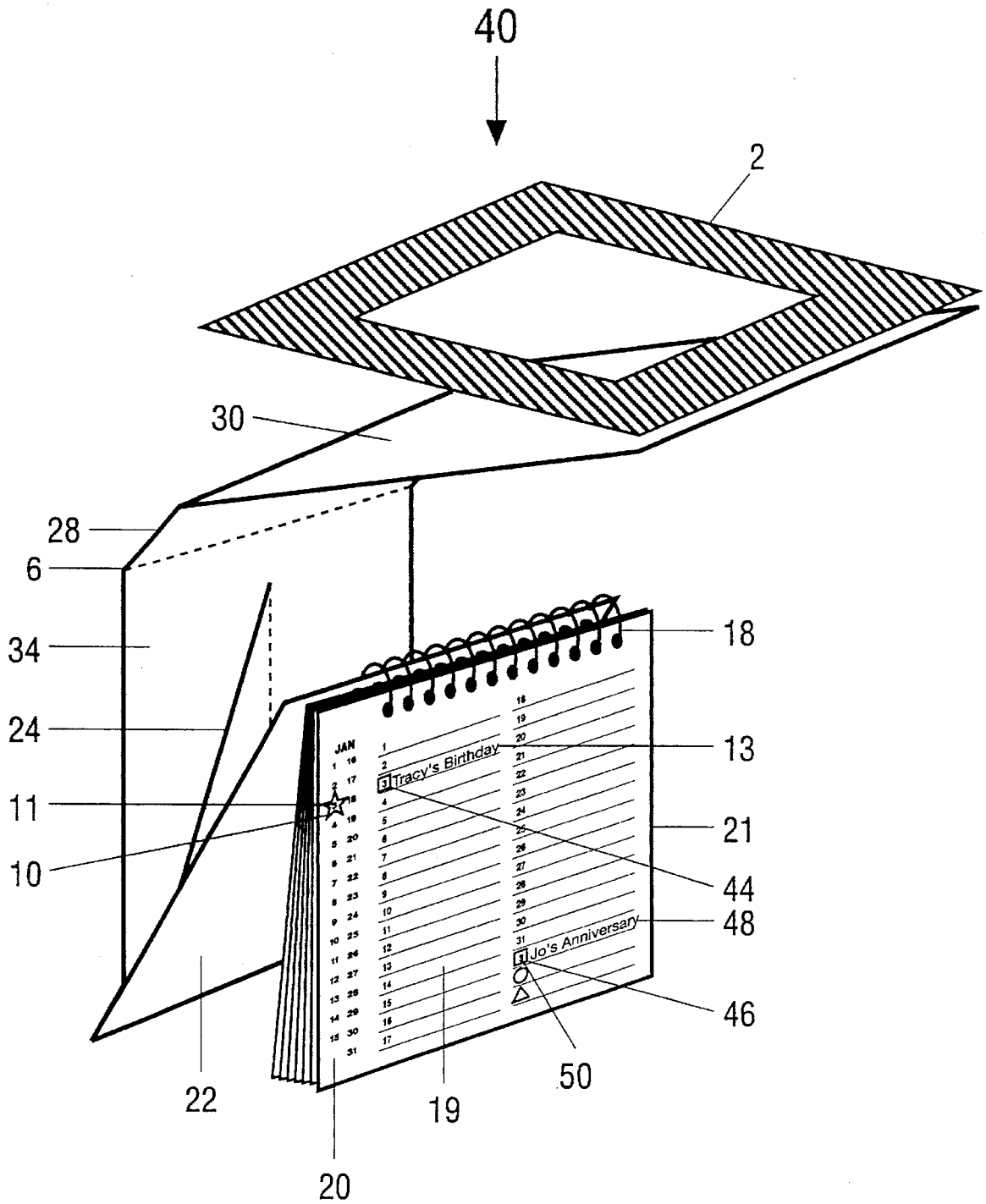
FIG. 4 is a partially assembled view of the combination desktop calendar and picture frame.

FIG. 4 is a partially assembled view of the present invention 40 showing how the picture frame mat 2 folds up and is adhered to the frame back 30 in such a way that a photograph or other picture 4 can be slid into the side of the resulting frame. If preferred, the two sections of the picture frame 2, 30 can be adhered so that the picture is slid in from the side or the top. This figure also shows how monthly calendar pages 21 are attached to the internal panel 22 of the cover by a spiral, comb, Wire-O™ or similar binding 18 so that the monthly calendar pages 21 can be flipped back into the recess created by the back panel 34, the bottom panel 26, and the internal panel 22. If the calendar page 21 is flipped so that the compact calendar 20 displayed is for the current month, the hidden portion 19 which is visible when the picture frame 2, 30 is lifted is also for the current month. The monthly calendar page 21 has lines or blank areas so that the user can add a reference to an event or special occasion. For example, Tracy's birthday is indicated by a tinted colored star 10 which the user has applied to the compact calendar 20 on January 3rd 11. The words "Tracy's Birthday" 13 are fully written in on the appropriate line of an expanded calendar located on the hidden portion 19 of the monthly calendar page 21. This way a user can glance at the calendar 40 and view the compact calendar 20 on the visible portion of the monthly calendar page 21 to determine if an event or special occasion is coming up and the type of event or special occasion. When the time draws near, the user can lift the picture frame 2, 30 of the calendar 40 to expose the hidden portion 19 of the monthly calendar page 21, thereby determining the specific information on the upcoming event.

In this case there is also a second event, Jo's Anniversary which also occurs on January 3rd. A square 44 has been placed around the date on the hidden portion 19 of the monthly calendar page 21. This square 44 corresponds to a square 50 located at the lower right of the hidden portion 19 of the calendar page 21. On the line corresponding to the square 50, the text "Jo's Anniversary" 48 has been fully written. If there was a different duplicate date, the user could use the circle or triangle. Alternately, the user could put one or two indicators onto the date on the compact calendar 20 and write two events on the appropriate line.

The present embodiment of the invention could be used year after year as a reminder of events. Without the standard calendar 36 there is no indication of the exact year. The user would no longer be required to transfer all the important dates from calendar to calendar as the years pass.

A variation of the present invention would use detachable calendar pages which could be replaced each year. This would be desirable for cases where the calendar is used for appointments and/or other events which do not recur on the same date each year or in cases where the calendar pages indicate a year or a day of the week and would therefore be outdated. In these cases, alternate binding techniques might be advantageous. For example, the calendar pages could be perforated at the top and slipped into the binding rings or glue bound at the top and attached to the internal panel 22. In these cases, when the month was over, the calendar page 21 could be torn off and discarded. For these embodiments, the internal panel 22 and the bottom panel 26 could be eliminated and the calendar pages 21 would be attached to the top of the back panel 34.

The examples given have the picture frame as an integral portion of the cover; however, this is not required. A separate picture frame 2, 30 may be used. In this case, the picture frame 2, 30 would then be attached to the top panel 28. A further variation would have a separate mat 2, as shown in FIG. 4, which would be attached to the frame back 30. The picture frame 2, 30 could be formed (made) of plastic, paperboard, foamboard, wood, metal, electronic circuit board, glass, paper, ceramic, leather, cloth, synthetic materials, vinyl or a combination of materials.

Another optional addition is a sheet of dear material such as dear vinyl, polycarbonate, glass, acetate, mylar, etc. This would be placed in front of the picture 4 to protect it from dust, debris and whatever else might damage the picture 4.

A further variation would be optimal for cases where there are not many calendar pages 21. In this embodiment, the calendar 40 would be thin enough that the top panel 28 could be omitted. In this case the picture frame 2, 30 would be attached directly to the back panel 34. The simplest versus of this variation would also omit the internal panel 12 and the bottom panel 26. The unit 40 would merely have the back panel 34, the front panel (formed of the mat 2 and the frame back 30) and the calendar pages 21 in between. In this case, all the elements 34, 2, 30, 21 would be bound together at the top.

Although the examples given include many specificities, they are intended as illustrative of a few possible embodiments of the invention. Other embodiments and modifications will, no doubt, occur to those skilled in the art. For example, a particular configuration of easel is shown and described. However, other types of easel and stands may be used. Also, the examples given all have the compact calendar displayed to the left side of the picture. However, if preferred, this could be placed in other locations such as to the right or below the picture. Thus, the examples given should only be interpreted as illustrations of some of the preferred embodiments of the invention, and the full scope of the invention should be determined by the appended claims and their legal equivalents.

I claim:

1. A calendar, comprising:

a cover having a front panel and a back panel, a support means attached to said back panel for supporting said calendar, and at least one calendar page, said at least one calendar page attached to said cover, said front panel of said cover being positionable to cover at least a portion of said at least one calendar page, wherein said front panel of said cover has a first position and wherein in said first position, said front panel hides a hidden portion of said at least one calendar page and leaves visible a visible portion of said at least one calendar page, and wherein said front panel of said cover has a second position, and wherein when said front panel is in said second position said hidden portion of said at least one calendar page is exposed.

2. The calendar of claim 1 wherein a compact calendar is printed on said visible portion of said at least one calendar page and wherein said hidden portion of said at least one calendar page has a date and an area corresponding to each of the dates exhibited on said compact calendar.

3. The calendar of claim 1 wherein said front panel of said cover forms a display means for displaying a flat sheet-like member.

4. The calendar of claim 3 wherein said front panel is made of at least one material chosen from the group of materials consisting of paper, paperboard, plastic, electronic circuit board, metal, glass, wood, foamboard, leather, cloth, synthetic materials, ceramic, and vinyl.

5. The calendar of claim 3 wherein said display means is a frame having an opening and a frame back panel.

6. The calendar of claim 1 wherein said cover is made of a material chosen from the group of materials consisting of paper and paperboard and wherein said cover is formed from a single folded sheet of material.

7. The calendar of claim 1 wherein said cover is formed from injection molded plastic.

8. The calendar of claim 1 wherein said front panel further comprises a full-year calendar located on a backside of said front panel.

9. The calendar of claim 1 wherein said support means is chosen from the group consisting of an easel, magnetic material, a hole and a slot.

10. A calendar, comprising:

a cover having a front panel and a back panel, a support means attached to said back panel for supporting said calendar, at least one calendar page, said at least one calendar page attached said cover, said front panel of said cover being positionable to cover at least a portion of said at least one calendar page, said front panel of said cover having a first position and wherein in said first position, said front panel hides a hidden portion of said at least one calendar page and leaves visible a visible portion of said at least one calendar page, a compact calendar being printed on said visible portion of said at least one calendar page, and adhesive shapes, said adhesive shapes being adherable to said compact calendar.

11. The calendar of claim 10 wherein said adhesive shapes have a distinct appearance to indicate a type of date.

12. The calendar of claim 11 wherein said distinct appearance is created by varying a factor of its visual appearance, said factor chosen from the group of factors consisting of color, shape and opacity.

13. A calendar, comprising:

a cover having a front panel and a back panel, a support means attached to said back panel for supporting said calendar, and at least one calendar page, said at least one calendar page attached to said cover, said front panel of said cover being positionable to cover at least a portion of said at least one calendar page, said front panel of said cover forming a display means for displaying a flat sheet-like member, said display means being a frame having an opening and a frame back panel, said frame extending above a top edge of said back panel.

14. A calendar, comprising:

a cover having a front panel and a back panel, said back panel having a top, a support means attached to said back panel for supporting said calendar, and at least one calendar page, said at least one calendar page attached to said cover proximate to said top of said back panel, said front panel of said cover being positionable to cover at least a portion of said at least one calendar page.

15. The calendar of claim 14 wherein said front panel of said cover has a first position and wherein in said first position, said front panel hides a hidden portion of said at least one calendar page and leaves visible a visible portion of said at least one calendar page.

16. The calendar of claim 15 wherein a compact calendar is printed on said visible portion of said at least one calendar page.

17. The calendar of claim 16 wherein said at least one calendar page is a plurality of calendar pages, and wherein a portion of said compact calendar is printed on each of said plurality of calendar pages, said portion being chosen from the group of portions consisting of a day, a week, a month, a quarter, a half of a year and a year.

18. The calendar of claim 15 wherein said front panel of said cover has a second position, and wherein when said front panel is in said second position said hidden portion of said at least one calendar page is exposed.

19. A calendar, comprising:

a cover having a front panel, a back panel, and an internal panel, said internal panel having a top, a support means attached to said back panel for supporting said calendar, and at least one calendar page, said at least one calendar page attached to said top of said internal panel, said front panel of said cover being positionable to cover at least a portion of said at least one calendar page.

20. The calendar of claim 19 wherein said front panel has a top edge, said back panel has a top edge and a bottom edge, and said internal panel has a bottom edge, said bottom edge of said internal panel being connected to said bottom edge of said back panel, and said top edge of said back panel being connected proximate to said top edge of said front panel.

21. The calendar of claim 20 wherein said internal panel is connected to said back panel by a bottom panel and said back panel is connected to said front panel by a top panel.

22. The calendar of claim 19 wherein said front panel of said cover has a first position and wherein in said first position, said front panel hides a hidden portion of said at least one calendar page and leaves visible a visible portion of said at least one calendar page.

23. A calendar, comprising:

a cover having a front panel, a back panel and an internal panel, said front panel of said cover having a top edge and an opening for displaying a flat sheet-like member, said back panel having a top edge and a bottom edge, said internal panel having a bottom edge, said top edge of said front panel being connected to said top edge of said back panel, said bottom edge of said back panel being connected to said bottom edge of said internal panel, a support means attached to said back panel for supporting said calendar, and at least one calendar page attached to said internal panel, wherein said front panel of said cover has a first position, wherein said front panel hides a hidden portion of said at least one calendar page and leaves visible a visible portion of said at least one calendar page, and wherein said front panel is movable to intermittently allow the user to view said hidden portion of said at least one calendar page.

24. The calendar of claim 23 wherein said cover is formed from a single folded sheet of material.

25. The calendar of claim 23 wherein said cover is formed from injection molded plastic.

26. The calendar of claim 23 wherein a compact calendar is printed on said visible portion of said at least one calendar page.

27. The calendar of claim 26 further comprising adhesive shapes, said adhesive shapes being adherable to said compact calendar.

28. The calendar of claim 26 wherein said adhesive shapes have a distinct appearance to indicate a type of date and wherein said distinct appearance is created by varying a factor of its visual appearance, said factor chosen from the group of factors consisting of color, shape and opacity.

* * * * *